US007854637B2

(12) United States Patent
Schultz

(10) Patent No.: US 7,854,637 B2
(45) Date of Patent: Dec. 21, 2010

(54) MULTIPLE VENTURI NOZZLE SYSTEM FOR WATERCRAFT

(75) Inventor: Wilderich C. Schultz, Chula Vista, CA (US); Terrence L. Smith, legal representative, Elfrida, AZ (US)

(73) Assignee: Marine Propulsion Technologies, Inc., Murrieta, CA (US)

( * ) Notice: Subject to any disclaimer, the term of this patent is extended or adjusted under 35 U.S.C. 154(b) by 57 days.

(21) Appl. No.: 11/988,243

(22) PCT Filed: Jun. 12, 2006

(86) PCT No.: PCT/US2006/023026

§ 371 (c)(1),
(2), (4) Date: May 8, 2008

(87) PCT Pub. No.: WO2007/005209

PCT Pub. Date: Jan. 11, 2007

(65) Prior Publication Data

US 2010/0167605 A1 Jul. 1, 2010

Related U.S. Application Data

(60) Provisional application No. 60/696,285, filed on Jul. 5, 2005.

(51) Int. Cl.
*B63H 1/16* (2006.01)

(52) U.S. Cl. ..... 440/67; 440/71

(58) Field of Classification Search ..... 114/274; 440/66, 67, 70, 71, 72, 73
See application file for complete search history.

(56) References Cited

U.S. PATENT DOCUMENTS

| | | | | | |
|---|---|---|---|---|---|
| 3,455,268 | A * | 7/1969 | Gordon | 440/67 |
| 3,457,891 | A * | 7/1969 | Corlett et al. | 114/163 |
| 4,637,801 | A * | 1/1987 | Schultz | 440/67 |
| 5,007,869 | A * | 4/1991 | Zoellner | 440/71 |
| 5,224,889 | A * | 7/1993 | Hickey | 440/71 |
| 5,292,088 | A * | 3/1994 | Lemont | 440/66 |
| 5,651,707 | A * | 7/1997 | Lemont | 440/67 |
| 5,848,922 | A * | 12/1998 | Itima et al. | 440/66 |
| 6,159,062 | A * | 12/2000 | Taylor, Jr. | 440/71 |
| 6,168,483 | B1 * | 1/2001 | McIntosh | 440/71 |
| 6,475,045 | B2 * | 11/2002 | Schultz et al. | 440/71 |
| 6,503,110 | B2 * | 1/2003 | Lammli | 440/71 |
| 7,270,584 | B1 * | 9/2007 | Mitchell | 440/71 |

* cited by examiner

*Primary Examiner*—Lars A Olson
(74) *Attorney, Agent, or Firm*—Richard D. Clarks

(57) ABSTRACT

The present invention is directed to a multiple propeller nozzle Venturi system and assembly consisting of two or more hydrodynamically shaped nozzle rings, axially located around the propeller and connected by the means of a plurality of equally spaced ring connecting fin struts to be used on a wide variety of sizes of watercrafts. By adjusting the conical inclination of one or more of the hydronamically shaped nozzle rings the water passing over is directed into the area of the propeller increasing the thrust pressure, thereby creating a Venturi effect. A skeg shield and a skid plate are incorporated to strengthen, or repair if broken, the lower portion of outboard and inboard-outboard motors. The overall effect of the multiple nozzle Venturi system is to enhance the performance, handling and control of a watercraft so equipped. Multiple nozzle Venturi systems are constructed to be adaptable to all sizes of vessels and all motors found on watercraft.

26 Claims, 9 Drawing Sheets

MULTIPLE VENTURI NOZZLE SYSTEM FOR WATERCRAFT

FIELD OF THE INVENTION

This invention relates to the field of watercraft powered by the means of a propeller and a unique means to shroud the propeller while increasing the output and performance. Propellers are the most common means of powering watercraft of all sizes. These propellers are most commonly at the rear of the watercraft and unshrouded. The manatee, seals, porpoise and whales are just a few of the water creatures that have been devastated by the propellers on watercrafts without the knowledge of the operators. Some states limit the times when boats are in certain areas and are considering making it a law that all watercraft have a propeller guard of some kind. The problem being that most propeller guards reduce the power and maneuverability of the watercraft. In shallow water or water with vegetation such as kelp, the unshrouded propellers on small watercraft become tangled while large watercraft propellers will shred the vegetation. Recreational watercraft operating where people may be in the water is extremely dangerous with the unshrouded propellers.

BACKGROUND OF THE INVENTION

This patent deals with a unique assembly of nozzles that shroud the propeller along with creating Venturi ports which adds water to the column filling in propeller disruptions, and increases the gallons per minute volume at the column discharge. Therefore, this patent deals with a unique multiple nozzle system that both shrouds the propeller and creates Venturi effects ports which direct propeller thrust, substantially improving the performance of the watercraft. By concentrating the thrust in a nozzle type of operation, the maneuverability and stability of the watercraft is greatly enhanced. Abrupt turns are possible because when the motor is turned the propeller is not sliding sideways, churning the water (cavitation), instead it is putting out a direct thrust in the desired direction. The stability is improved because the up and down movement or porpoising of the watercraft is minimized due to the direct flow of the water through the propeller nozzle assembly and the resistance to an up and down movement through the water by the assembly shrouds hydrodynamic configuration.

The inventor, possessing U.S. Pat. No. 4,637,801 Thrust Enhancing Propeller Duct Assembly for Watercraft, and U.S. Pat. No. 6,475,045 Thrust Enhancing Propeller Guard Assembly, has endeavored in this patent to refine his device making it function for large watercraft along with improving the mounting brackets, structural members and reinforcing the lower member to protect the skeg on outboard and inboard-outboard motors. Most outboard motors and many inboard-outboard have a fin type of protrusion below the propeller housing called the skeg which is the first thing on the motor to hit obstacles in the water. The inventors' endeavors in the field of watercraft propeller guards, includes the Kort Nozzle that is known worldwide. Additional patents issued to inventors endeavoring to create propeller guards are as follows:

U.S. Pat. No. 4,957,459 of Richard H. Snyder describes a marine drive propeller shroud with a cage having an internal spoke structure and a retainer structure mounting the cage to the gear case and engaging the gear case and drive shaft housing in a particular manner such that impact on the cage is transmitted to the junction of the lower skeg and the torpedo-shaped portion of the gear case, the leading edge of the gear case at the front edge the strut portion and the front edge of the skeg, the underside of the anti-cavitation plate and the rearwardly extending portion of the drive shaft housing above the cavitation plate and the splash plate.

This patent describes a conventional wire frame propeller guard that endeavors to add some protection to the skeg area of the motor, but greatly restricts the water flow past the torpedo-shaped gear case minimizing the output of the motor and greatly affecting the maneuverability of the watercraft. These styles of propeller guards have a tendency to churn the water around the propeller creating air bubbles and hampering the designed smooth water flow past the propeller.

U.S. Pat. No. 5,066,254 of Joseph D. Bass et al. describes a propeller guard primarily for the protection of the manatee but is also useful in the protection against injury to other animals and larger fish which might come in contact with a boat's propellers. This guard is tapered substantially toward a point at the front and is substantially circular at the rear end to encircle the region in which the propeller is rotated. The guard has a V-bracket at the front, which is securely pressed against a propeller support and is supported at the rear in the circular portion by a pair of clamps that engage and are bolted tightly onto the anti-cavitation plate.

This patent describes another simpler configuration of a wire frame propeller guard offering limited protection to the skeg, but still restricts water flow past the propeller and hampers the maneuverability of the watercraft.

U.S. Pat. No. 5,009,620 of Louis Feranda, Sr. describes a propeller guard that is provided with replaceable ribs that form a cage placed around the propeller of an outboard marine propulsion unit. The ribs are suspended from a flat upper plate bolted to the cavitation plate above the propeller. The ribs are maintained in spaced relation to each other around the propeller by the support plate and a longitudinally extending bottom bar bolted at one end to the skeg of the propulsion unit. In the event of damage to any of the ribs of the cage, the damaged rib can easily be replaced with a new one.

This patent describes still another wire frame or rib style of configuration with the advantage of replacing separate ribs when they are damaged. This guard offers no protection to the skeg area of the motor and still restricts water flow past the propeller and hampers the maneuverability of the watercraft. Again, these styles of propeller guards have a tendency to churn the water around the propeller creating air bubbles hampering the designed smooth water flow past the propeller.

U.S. Pat. No. 5,928,042 of James Quiggins describes a propeller guard for use in association with a boat propulsion propeller driven by an outboard motor or an inboard-outboard rear motor drive unit. The propeller guard may be constructed of injection molded plastic, fiber reinforced resin, metal such as aluminum or other materials having strength characteristics to provide necessary protection and constructed to minimize hydrodynamic resistance. The propeller guard will protect swimmers, aquatic mammals and other sea life from coming into contact with the propeller thereby preventing injury and at the same time protect the propeller from damage by engagement with floating or submerged debris.

This patent describes a propeller guard using flat configuration to minimize the hydrodynamic resistance, but does not eliminate it or does not attempt to direct the water flow into the area of the propeller. This propeller guard also offers no protection to the area of the skeg of the motor.

U.S. Pat. No. 5,975,969 of John Forrest White describes a hydrofoil propeller guard, including a thrust tube, a hydrofoil fin and bottom securing plate. This device is used in conjunction with an outboard motor mounted on a boat with stern drives, to encompass the propeller to reduce sideways thrust, to move items away from the propeller, and the guard preferably includes a trolling plate to increase slow speed performance.

This patent describes a hydrofoil propeller guard with a single thrust tube with the flat sides parallel to the centerline of the propeller shaft. This design incorporates the conventional hydrofoil and allows for minimum drag but does not direct the water flow towards the propeller and does not reinforce the area of the skeg. If debris is directed into the area of the propeller, there is a relatively large area where it may enter and in doing so can knock the thrust tube into the propeller.

None of the foregoing prior art teaches or suggests the particular unique features of the propeller nozzle assembly and thus clarifies the need for further improvements in the safety devices used on watercraft.

SUMMARY OF THE INVENTION

In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

This invention will consist of a propeller nozzle assembly consisting of two or more hydrodynamically shaped nozzle rings, axially located around the propeller and connected by the means of a plurality of equally spaced ring connecting fin struts to be used on a variety of sizes of watercrafts. The preferred embodiment of the propeller nozzle assembly will consist of three hydronamically shaped rings. The first structural ring axially located around the propeller will be smaller in diameter than the propeller having its centerline axis parallel to the centerline axis of the propeller drive shaft. The second ring, the first nozzle ring, is axially located around the propeller and will be larger in diameter than the propeller with its centerline axis parallel to the centerline axis of the propeller drive shaft, but with the nozzle ring conically inclined to the rear. By conically inclining the axis to the rear, the water flow between the first and second nozzle ring is directed into the area of the propeller increasing the thrust pressure, thereby creating a Venturi effect. The third nozzle ring axially located around the propeller behind the second nozzle ring will be larger in diameter than the propeller with its centerline axis parallel to the centerline axis of the propeller drive shaft. By the conical inclination of the second hydronamically shaped nozzle ring the water passing over is additionally directed into the area of the propeller further increasing the thrust pressure, thereby creating a Venturi effect. The theory behind the propeller nozzle assembly is similar to that of a jet engine where air is directed into the turbine blades, compressed into the combustion chamber and ejected out the rear. A fourth structural safety ring of a smaller diameter with the centerline axis parallel to the centerline axis of the propeller drive shaft can be added for safety protecting the rear of the propeller as an integral part of the propeller nozzle assembly or it may be a separate part to be attached to the rear of the device.

One or more hydrodynamically shaped nozzle ring(s) connecting fin struts will retain the nozzle rings in a fixed position on the left and right sides (port and starboard halves) of the propeller nozzle assembly with the preferred embodiment having three on each side.

The upper mounting plate on each side of the propeller nozzle assembly is attached to the anti-cavitation plate on the motor by the means of stainless steel fasteners. The lower mounting plate on each side of the propeller nozzle assembly is attached through the skeg shield and skeg on the motor and through the skid plate by the means of stainless steel fasteners.

On larger watercraft with the motor housed within the hull, a variety of different mounting plates along with the number of hydrodynamically shaped rings and number of hydrodynamically shaped nozzle rings connecting fin struts required may vary, along with the geometrical shape of the propeller nozzle assembly, other than round. The nozzle rings may have a square, hexagonal or octagonal configuration performing the same function, and it must be understood that this will still be covered within the scope of this patent.

The preferred embodiment of the propeller nozzle assembly consisting of two or more hydrodynamically shaped nozzle rings along with the second and third embodiment primarily deal with the propellers in the rear of the propeller gearbox housing while the third, fourth and fifth deal with the optional geometrical shapes to the nozzle rings. A sixth alternate embodiment of the invention will have all the same properties except that the hydrodynamic shape of the nozzle rings will be reversed where the thrust force is directed by the gearbox. A variety of mounting configurations will be available to attach to the different manufacturers products. This configuration will be used with the azimuth thruster type of drive systems. The basic idea behind an azimuth thruster is that the propeller can be rotated 360 degrees around the vertical axis, providing omni-directional thrust. These systems may employ counter-rotating propellers in a leading position through the water, which makes them exceptionally dangerous without a guard on the propellers, to anything in the water in front of the rotating propellers.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

THE OBJECTS OF THE INVENTION

The principal object of the propeller nozzle assembly is to safely shroud the propeller of a wide variety of sizes and types of watercraft, and to enhance the performance, handling and control of said watercraft so equipped.

Another object of the propeller nozzle assembly is to increase efficiency and the thrust put out by the propeller by increasing the pressure of the water in contact with the propeller while concentrating and directing its force, thereby creating a Venturi effect.

Another object of the propeller nozzle assembly is to improve the handling and maneuverability of a wide variety of sizes of watercraft.

Another object of the propeller nozzle assembly is to improve fuel consumption of watercrafts.

Another object of the propeller nozzle assembly is to minimize propeller and skeg damage.

Another object of the propeller nozzle assembly is to reduce the up and down pounding, called porpoising, of small watercraft.

Another object of the propeller nozzle assembly is to provide a device that can be easily attached to a wide variety of sizes of watercraft including those where the rudder is behind the propeller.

Another object of the propeller nozzle assembly is to reduce the harm to water creatures and their habitat.

And still another object is to create a reinforced structural member of the propeller nozzle assembly that can be attached to the upper portion of the skeg adjacent to the propeller shaft housing on outboard and inboard-outboard boat motors, even if the skeg has been badly damaged.

A further object of the propeller nozzle assembly is to provide a protective structure, such as a skid plate, to further reinforce the structural member attached to the skeg.

And yet a further object of this invention is to add a new and improved device to the area of watercraft safety.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred and alternate embodiments of the invention. There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

The accompanying drawings, which are incorporated in and form a part of this specification, illustrate embodiments of the invention and together with the detailed description, serve to explain the principles of this invention.

DETAILED DESCRIPTION OF THE PREFERRED EMBODIMENTS

Figure 1:
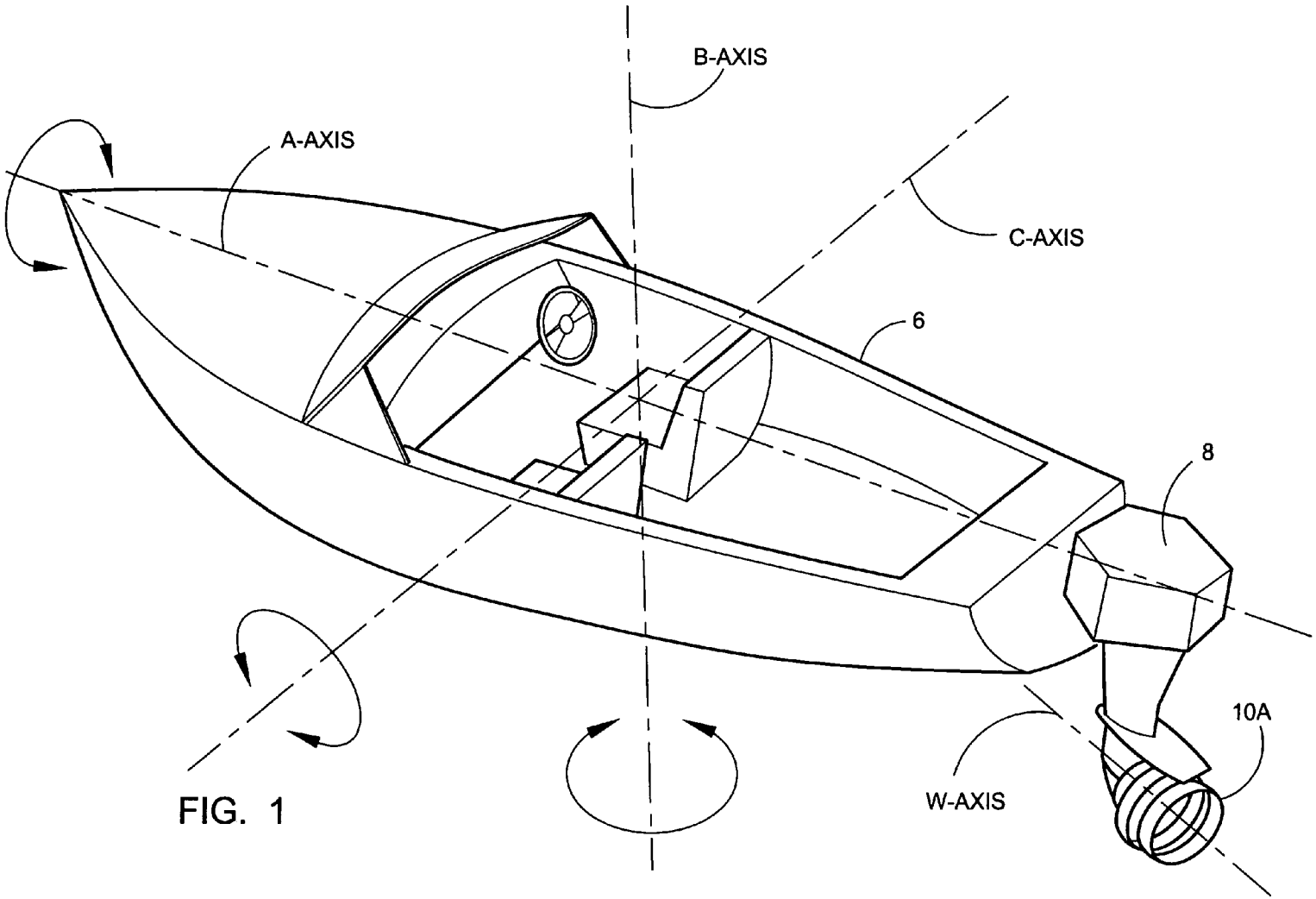
FIG. 1 depicts a perspective view of a conventional watercraft with an outboard motor using the propeller nozzle assembly.

Referring now to the drawings, wherein similar parts are identified by like reference numerals, there is seen in FIG. 1 a perspective view of a conventional watercraft 6 with an outboard motor 8 using the propeller nozzle assembly 10A displaying the theoretical axes of motion involved when operating a watercraft. The A-AXIS is the theoretical axis of rotation when a watercraft rocks from side to side. The B-AXIS is the theoretical axis of rotation when a watercraft is turned to the port or starboard. The control in this action is greatly enhanced due to the unique directional thrust by the propeller when the propeller nozzle assembly is used. The C-AXIS is the theoretical axis when the bow of a watercraft rises and the stern goes down. This up and down movement is called a "porpoising" movement, which is greatly minimized by the addition of the propeller nozzle assembly. The W-AXIS is the theoretical centerline axis of the propeller drive shaft and propeller nozzle assembly.

Figure 2:
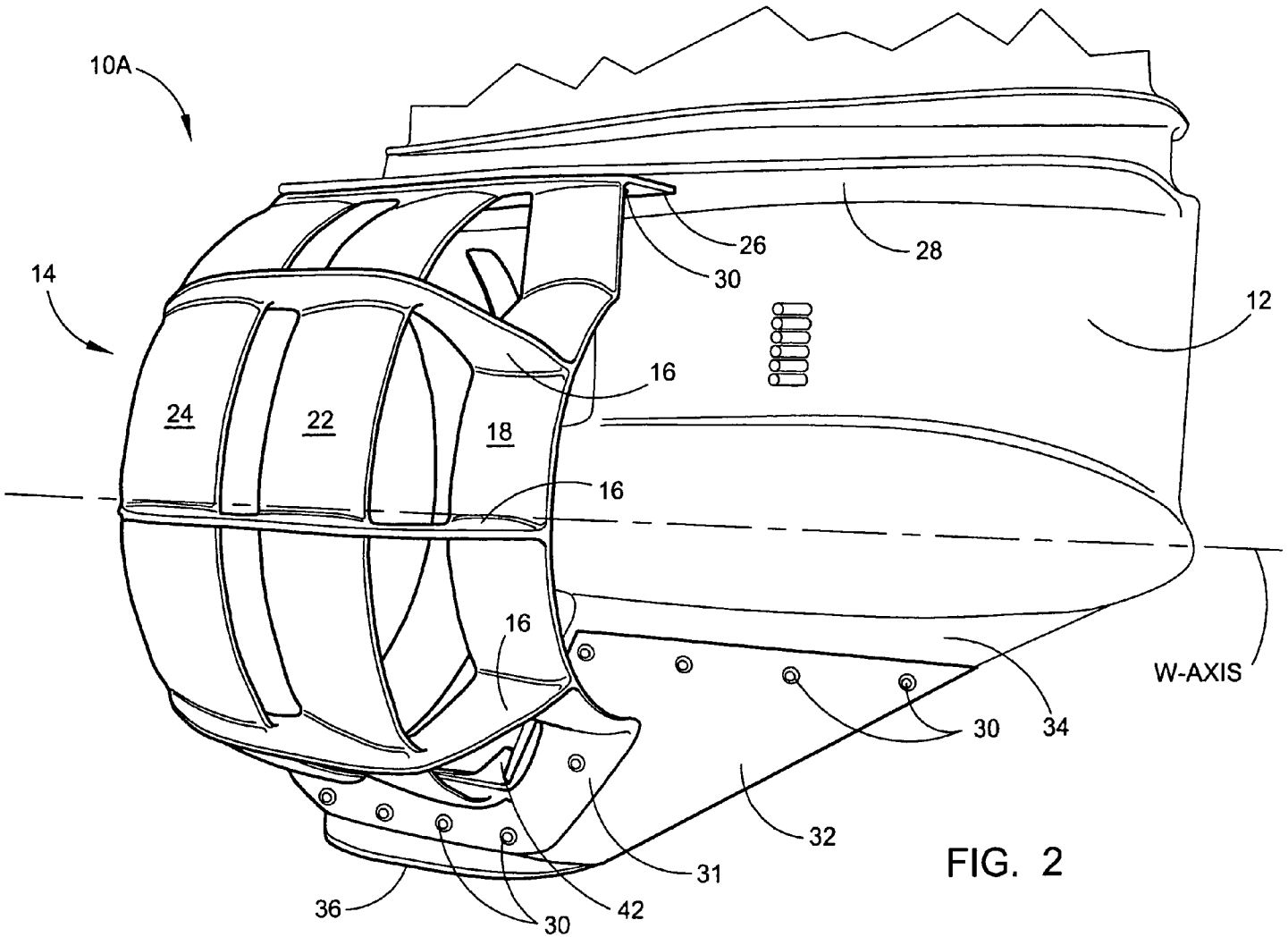
FIG. 2 depicts a perspective view of the preferred embodiment of the propeller nozzle assembly attached to a conventional propeller gearbox housing.

FIG. 2 a perspective view of the preferred embodiment of the propeller nozzle assembly 10A attached to a conventional propeller gearbox housing 12. Hydrodynamically shaped nozzle rings 14 are axially located around the propeller gearbox housing 12 and connected by the means of a plurality of equally spaced hydrodynamically shaped ring connecting fin struts 16. The preferred embodiment of the propeller nozzle assembly 10A will consist of three hydronamically shaped nozzle rings 14. The first structural ring 18 is axially located around the propeller gearbox housing 12 and will be smaller in diameter than the propeller 20, not shown in FIG. 2. The second nozzle ring 22 is axially located around the propeller 20 and will be larger in diameter than the propeller 20. The third nozzle ring 24 is axially located around the propeller 20 behind the second nozzle ring 22 and will be larger in diameter than the propeller 20.

The upper mounting plate 26 on each side of the propeller nozzle assembly 10A is attached to the motor cavitation plate 28 on the propeller gearbox housing 12 by the means of stainless steel fasteners 30. The multiple nozzle Venturi system for watercraft on each side of the propeller nozzle assembly 10A is attached through the skeg shield 32 and skeg 34 on the propeller gearbox housing 12 and through the skid plate 36 by the means of stainless steel fasteners 32.

Figure 3:
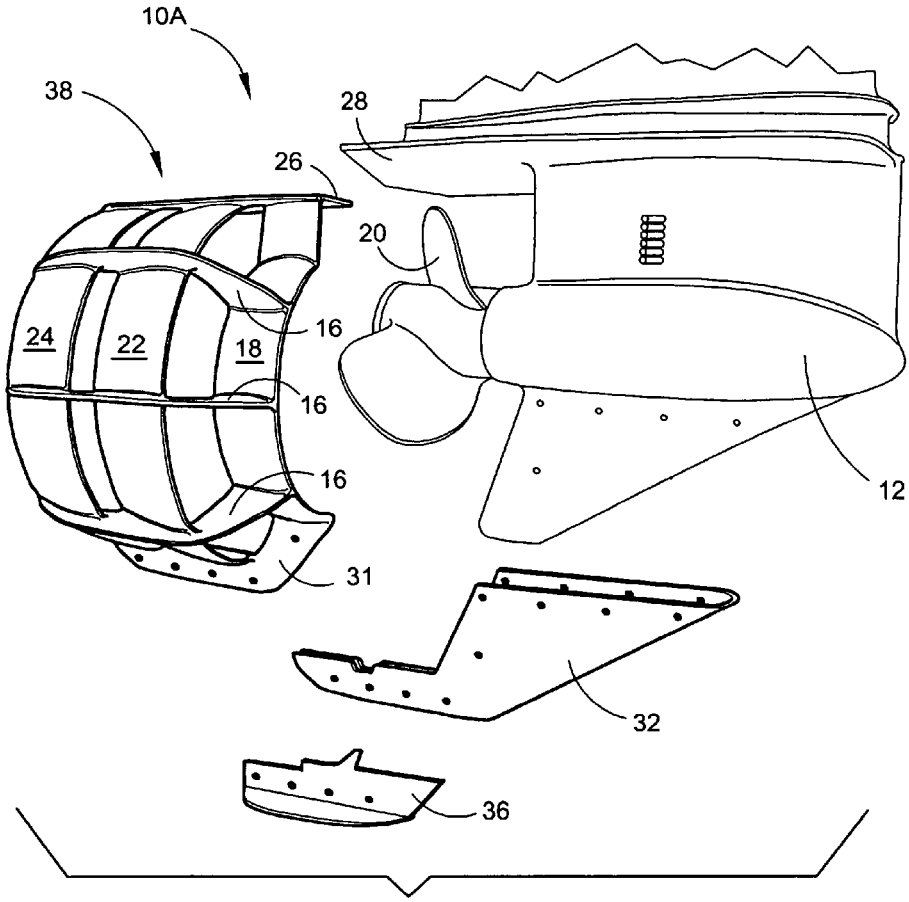
FIG. 3 depicts an exploded view of the preferred embodiment of the propeller nozzle assembly adjacent to a conventional propeller gearbox housing.

FIG. 3 depicts an exploded view of the preferred embodiment of the propeller nozzle assembly 10A adjacent to a conventional propeller gearbox housing 12 defining the individual parts, the propeller nozzle assembly right side 38, the skeg shield 32, and the skid plate 36. When fully assembled and attached to the watercraft motor skeg, the lower mounting plate 31, the skeg shield 32, and the skid plate 36 extends and strengthens the watercraft motor skeg. They strengthen the skeg so much so that the assembled structure will support the entire vessel. Moreover, in reverse motion collisions, the skeg, propeller and lower motor section are fully protected from damage. These parts, the lower mounting plate, the skeg shield 32, and the skid plate 36 combined create enough structure to support the watercraft and not collapse the propeller nozzle assembly 10A in the event of contact with the bottom with the motor locked in the vertical position or coming off of a wave in shallow water operation. Said parts, when assembled, also give added strength in the event of reverse contact with immovable objects.

Figure 4:
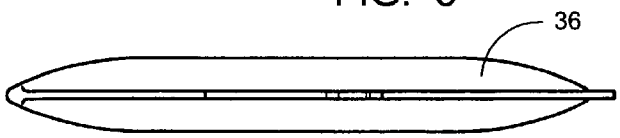
FIG. 4 is a top view of the propeller nozzle assembly skid plate.
Figure 5:
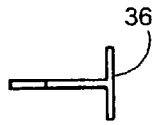
FIG. 5 is an end view of the propeller nozzle assembly skid plate.
Figure 6:
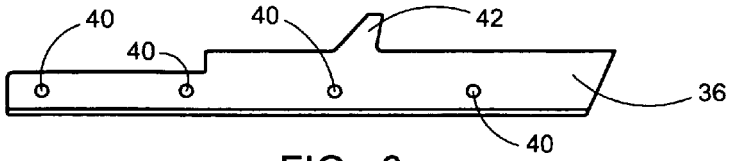
FIG. 6 is a side elevation of the propeller nozzle assembly skid plate.

FIG. 4 is a top view of the propeller nozzle assembly skid plate 36 with FIG. 5 showing an end view. FIG. 6 is a side view of the skid plate 36 depicting the mounting holes 40 and the skeg lock 42. The skeg lock 42 engages behind the rear of the skeg 34 to keep the propeller nozzle assembly 10A from moving forward.

Figure 7:
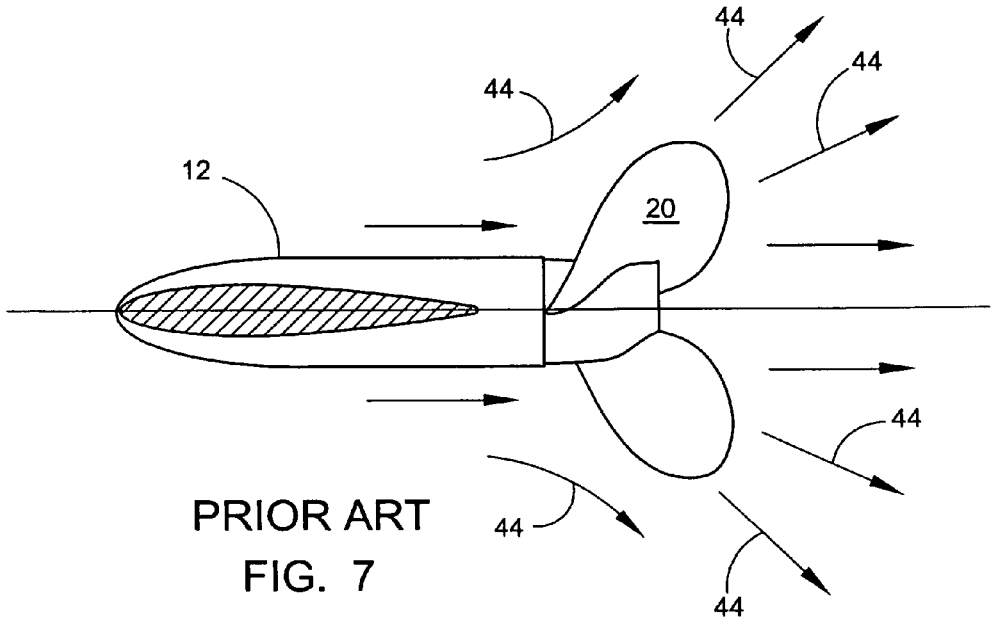
PRIOR ART FIG. 7
FIG. 7 is a top view of the conventional prior art showing the propeller and gearbox along with the lines of force produced by the vortex of the rotating propeller.

FIG. 7 is a top view of the conventional prior art showing the propeller 20 and propeller gearbox housing 12 along with the outwardly extending lines of water force 44 produced by the vortex of the rotating propeller 20.

Figure 8:
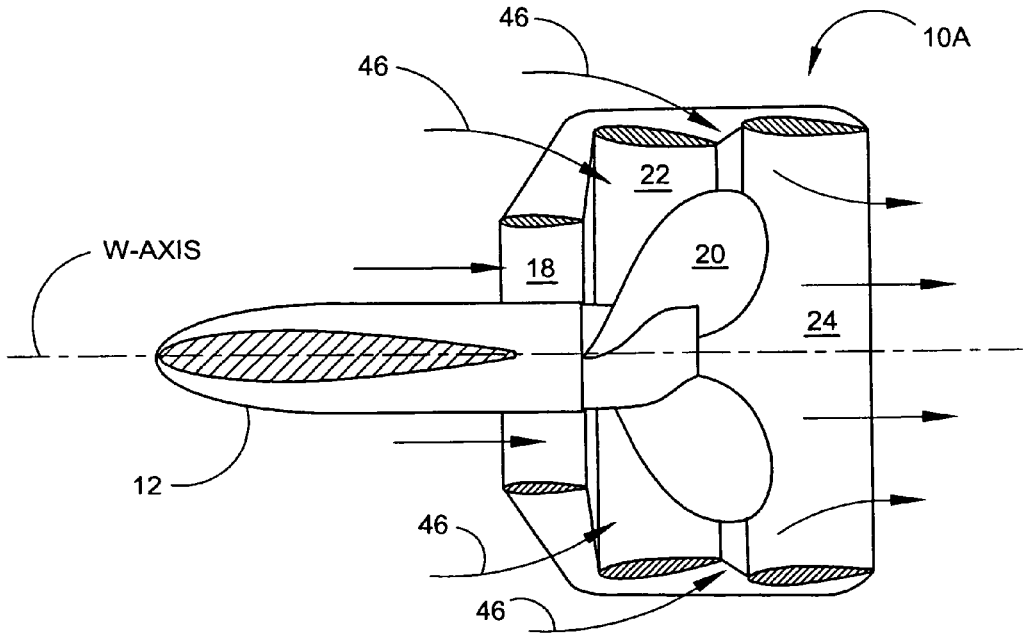
FIG. 8 is a top view of the propeller nozzle assembly attached to a conventional propeller and gearbox along with the concentrated lines of force produced by the vortex of the rotating propeller, thereby creating a Venturi effect.

FIG. 8 is a top view of the propeller nozzle assembly 10A attached to the propeller 20 and propeller gearbox housing 12 along with the concentrated lines of water force 46 produced by the vortex of the rotating propeller 20 along with the water passing on both sides of the conical hydrodynamic shape of the second nozzle ring 22 to be thrust in a straight line out the rear of the device. It must be understood at this time that this description describes the second nozzle ring 22 as the only ring with a conical hydrodynamic shape, but additional nozzle rings 22 of this configuration could be added and still remain within the scope of this patent.

Figure 9:
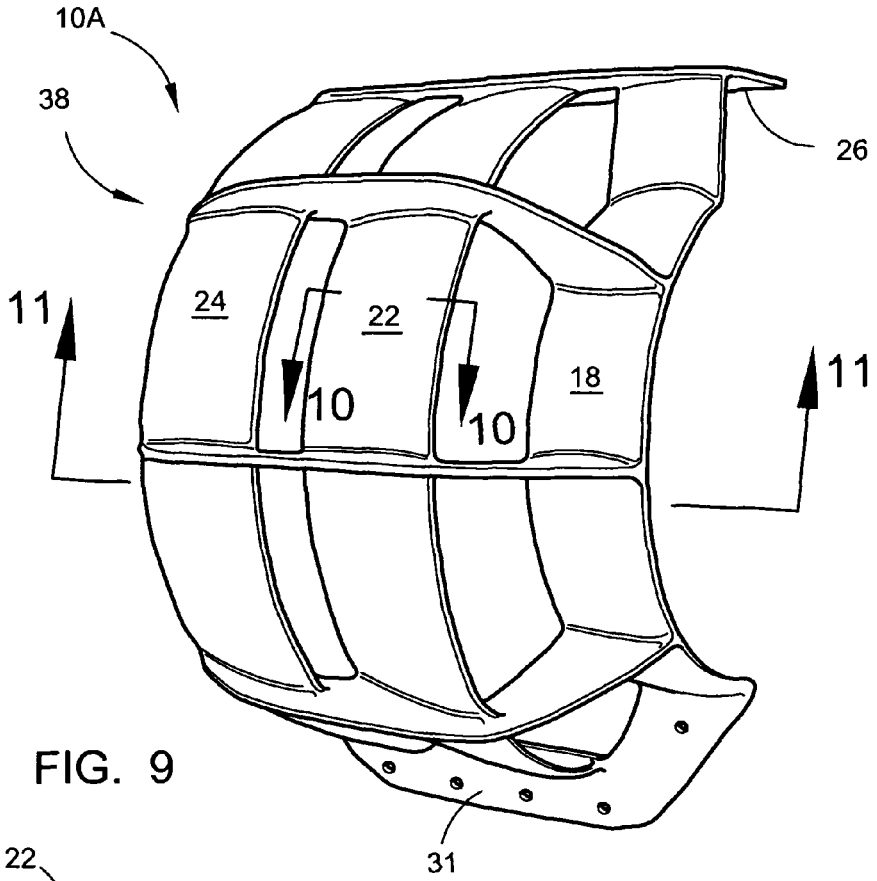
FIG. 9 depicts a perspective view of half of the ring section of the preferred embodiment of the propeller nozzle assembly illustrating the locations of the sections taken for FIG. 10 and FIG. 11.
Figure 10:
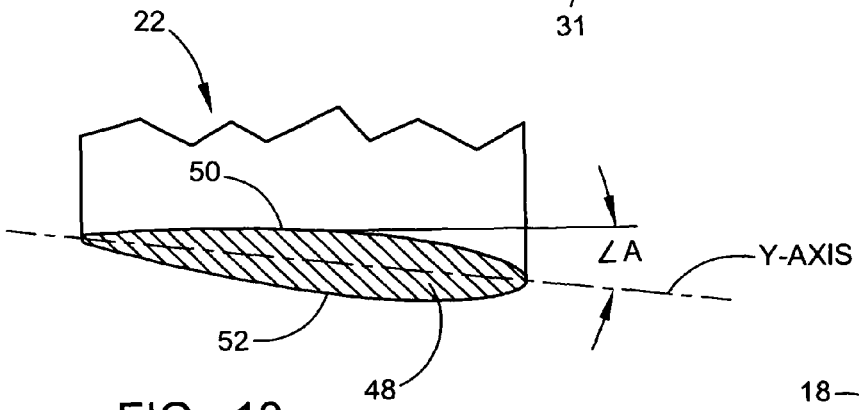
FIG. 10 is a typical nozzle ring cross section profile.
Figure 11:
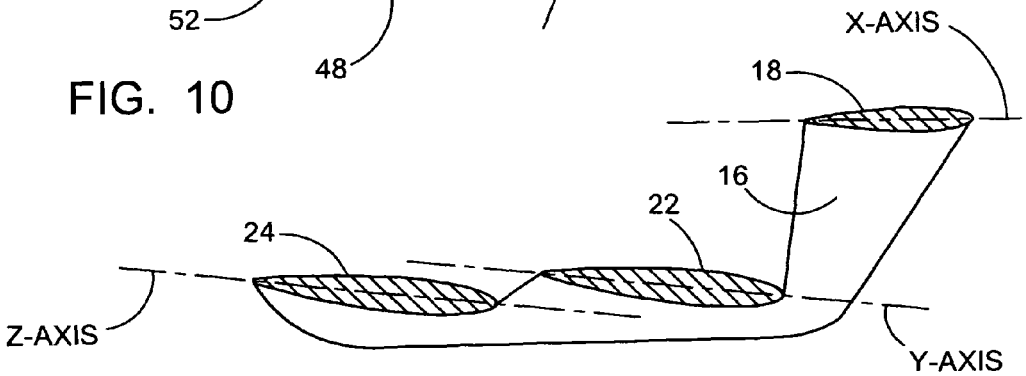
FIG. 11 is a section through the preferred embodiment of the propeller nozzle assembly illustrating a typical ring connecting fin strut.

FIG. 9 depicts a perspective view of the propeller nozzle assembly right side 38 of the preferred embodiment of the propeller nozzle assembly 10A illustrating the locations of the sections taken for FIG. 10 and FIG. 11. FIG. 10 is a typical nozzle ring cross section profile 48 illustrating the Y-AXIS and the conically inclined ∠A, at 6 degrees. Varying angles and the number of conically inclined nozzle rings 14 can increase or decrease the thrust pressure put out by the propeller 20. The typical nozzle ring cross section 48 is shown in a symmetrical configuration with the inner surface 50 symmetrical with the outer surface 52 in the hydrodynamic shape. It must also be understood that the nozzle ring cross section 48 could be constructed in a similar aerodynamic shape as an airplane wing, where the inner surface 50 is much shorter than the outside surface 52 and still be covered within the scope of this patent.

FIG. 11 is a section through the preferred embodiment of the propeller nozzle assembly 10A illustrating the hydrodynamically shaped nozzle rings 18, 22 and 24 connecting to the hydrodynamically shaped ring connecting fin struts 16. This drawing illustrates that in the preferred embodiment of the propeller nozzle assembly 10A the X-AXIS of the first structural ring 18 and the Z-AXIS of the third nozzle ring 24 are parallel to the centerline W-AXIS, shown in FIG. 7 and FIG. 8, of the propeller gearbox housing 12, while the Y-AXIS of the second nozzle ring 22 is conically angled in at the rear.

Figure 12:
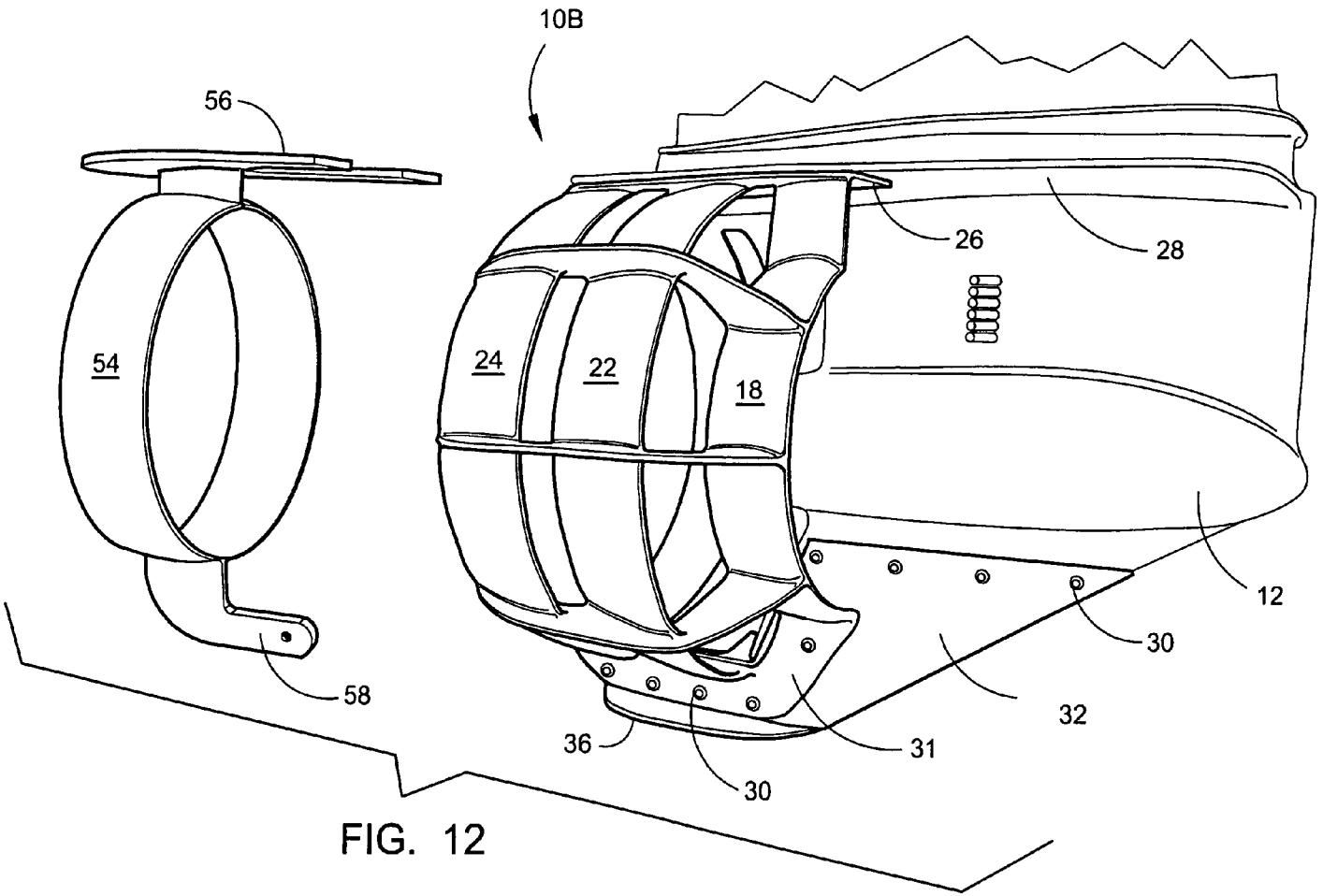
FIG. 12 is a perspective view illustrating the first alternate embodiment of the propeller nozzle assembly incorporating a fourth rear safety ring.

FIG. 12 is a perspective view illustrating the first alternate embodiment of the propeller nozzle assembly 10B incorporating a fourth hydrodynamically shaped rear safety ring 54 with an upper safety ring-mounting plate 56 and a lower safety ring-mounting bracket 58.

Figure 13:
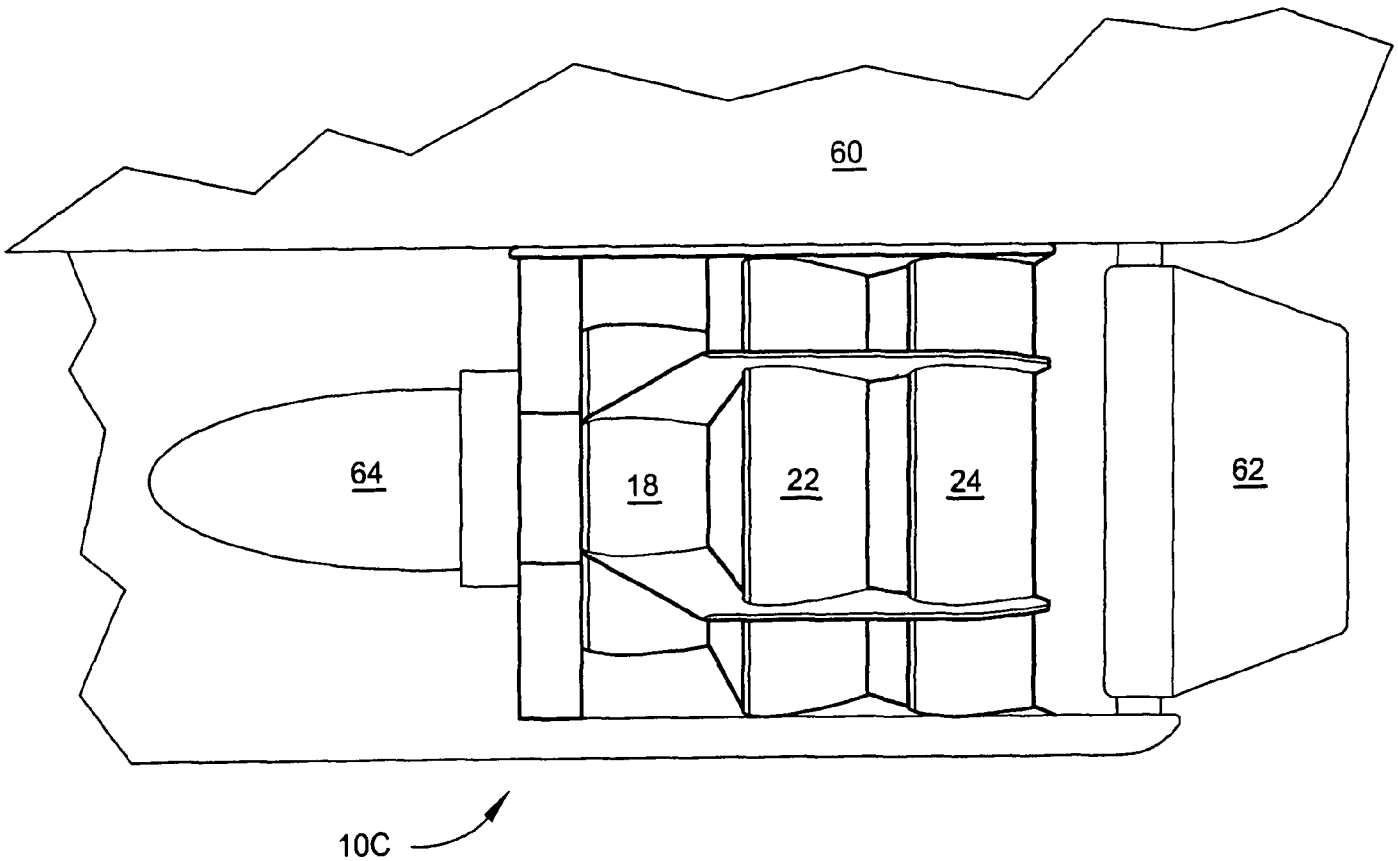
FIG. 13 depicts a side view of the second alternate embodiment of the propeller nozzle assembly adapted to a large watercraft with an inboard motor and the rudder behind the propeller.

FIG. 13 depicts a side view of the second alternate embodiment of the propeller nozzle assembly 10C adapted to a large watercraft 60 with an inboard motor and the rudder 62 behind the propeller gearbox housing 64. Three hydrodynamically shaped nozzle rings 18 (which is a structural ring only), 22 and 24 are shown, but in some cases only two nozzle rings 22 and 24 will be used on larger watercraft to achieve the desired results because the propeller nozzle assembly 10C is in a fixed position and not required for steering. The steering of larger watercrafts is accomplished with a rudder 62.

Figure 14:
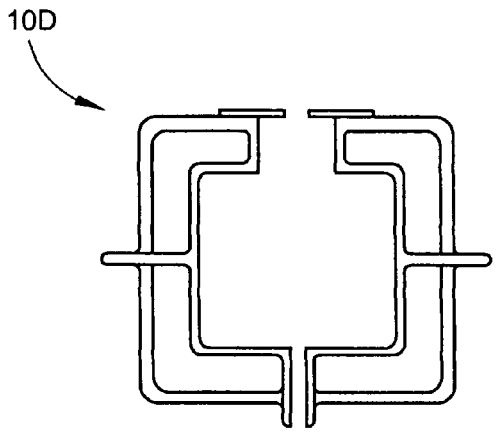
FIG. 14 is a front view of a third alternate embodiment in a square configuration.
Figure 15:
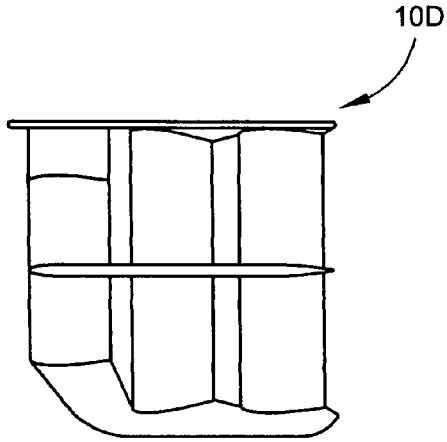
FIG. 15 is a side view of a third alternate embodiment in a square configuration.

In the preferred embodiment of the propeller nozzle assembly 10A the hydrodynamically shaped nozzle rings 14 are in a round configuration, but other geometric shapes will also be covered within the scope of this patent shown in FIGS. 14 through 19. FIG. 14 is a front view of a third alternate embodiment of the propeller nozzle assembly 10D in a square configuration. FIG. 15 is a side view of a third alternate embodiment of the propeller nozzle assembly 10D in a square configuration. Rectangular shape is also contemplated in certain applications.

Figure 16:
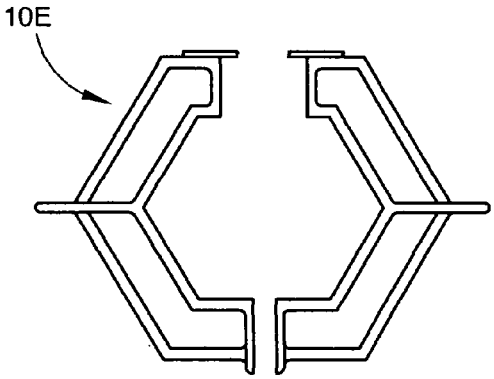
FIG. 16 is a front view of a fourth alternate embodiment in a hexagonal configuration.
Figure 17:
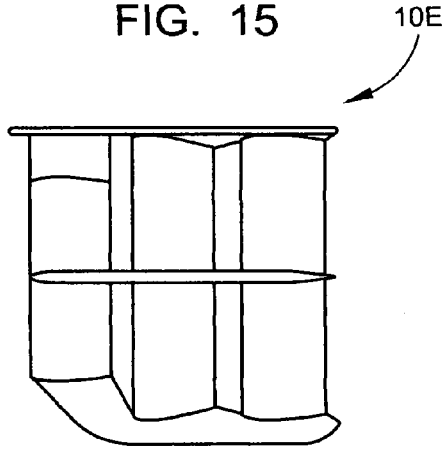
FIG. 17 is a side view of a fourth alternate embodiment in a hexagonal configuration.

FIG. 16 is a front view of a fourth alternate embodiment of the propeller nozzle assembly 10E in a hexagonal configuration. FIG. 17 is a side view of a fourth alternate embodiment of the propeller nozzle assembly 10E in a hexagonal configuration. Therefore, all polygonal shapes are contemplated.

Figure 18:
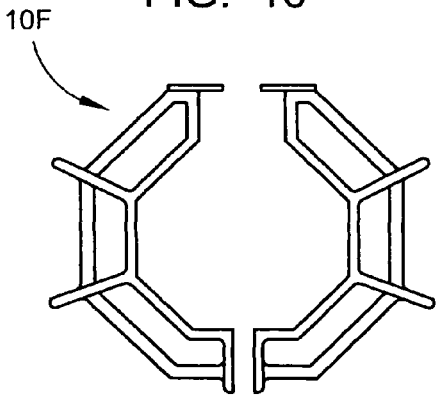
FIG. 18 is a front view of a fifth alternate embodiment in an octagonal configuration.
Figure 19:
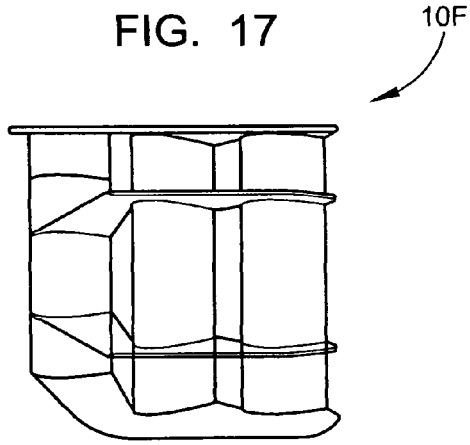
FIG. 19 is a side view of a fifth alternate embodiment in an octagonal configuration.

FIG. 18 is a front view of a fifth alternate embodiment of the propeller nozzle assembly 10F in an octagonal configuration. FIG. 19 is a side view of a fifth alternate embodiment of the propeller nozzle assembly 10F in an octagonal configuration.

Additionally, while not shown in the figures, it is contemplated that elliptical shapes may also be employed in certain applications.

Figure 20:
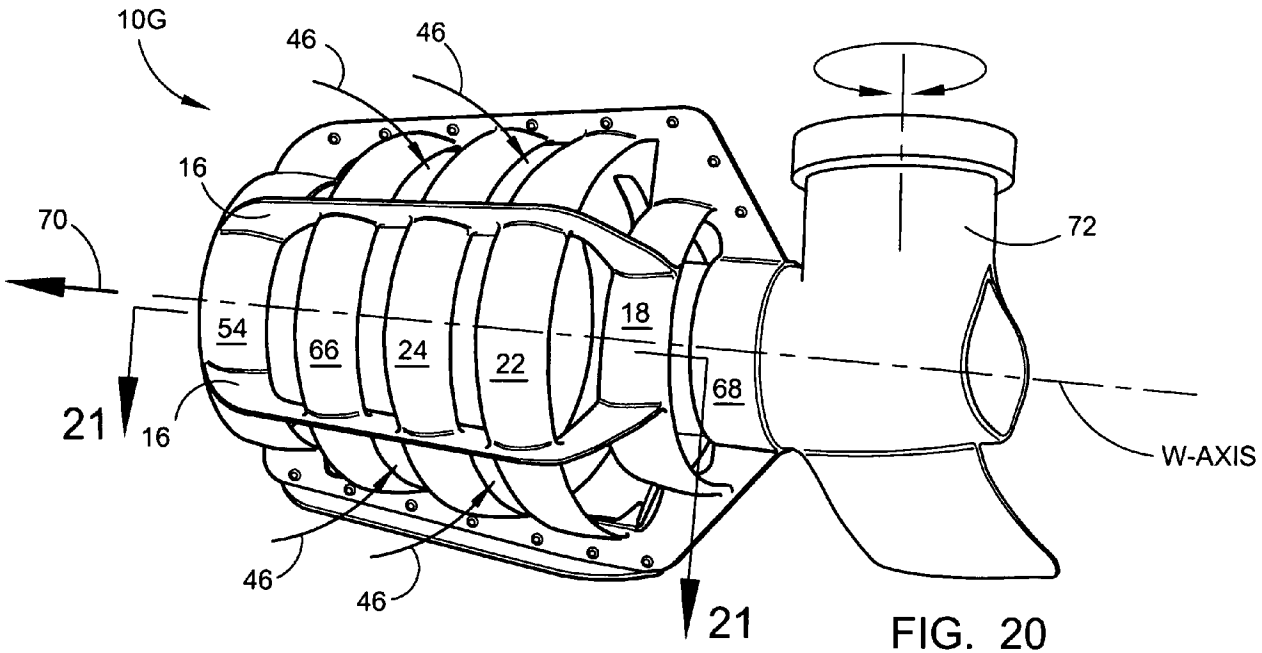
FIG. 20 depicts a perspective view of the sixth alternate embodiment of the propeller nozzle assembly to be used with the azimuth thruster type of drive systems.

FIG. 20 depicts a perspective view of the sixth alternate embodiment of the propeller nozzle assembly 10G that will have all the same properties except that the hydrodynamic shape of the nozzle rings 18 (which is a structural ring only), 22, 24, 66 and 54 will be reversed. This configuration will be used with the azimuth thruster type of drive systems capable of rotating 360° and where the forward motion 70 of the water craft is provided by the means of the propellers 20 that are forward of the gearbox 72. A variety of mounting configurations 68 will be available to attach to the different manufacturers gearbox 72.

Figure 21:
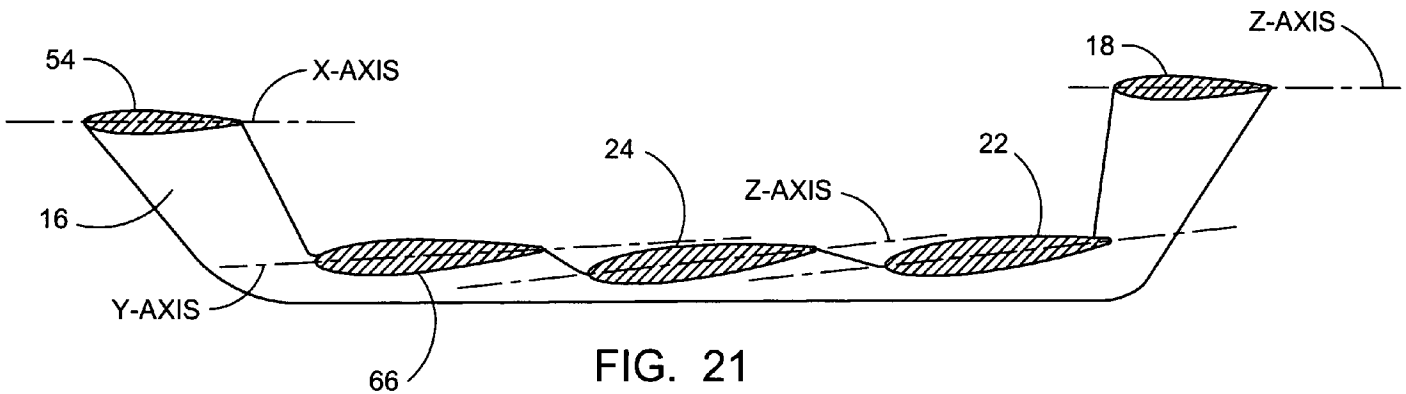
FIG. 21 is a section through the sixth alternate embodiment of the propeller nozzle assembly illustrating the ring connecting fin strut with the hydrodynamic shape of the nozzle rings reversed.

FIG. 21 is a section through the sixth alternate embodiment of the propeller nozzle assembly 10G illustrating the ring connecting fin strut 16 with the hydrodynamic shape of the nozzle rings 18 (which is a structural ring only), 22, 24, 66, and 54 in the reversed direction.

Finally, it should be noted that the multiple nozzle Venturi system, when installed, greatly enhances performance, handling and control of the vessel so equipped. Many vessels require trim tabs, trim plates or dolphin fins be installed to assist in stabilization of the vessel. The multiple nozzle Venturi system when installed, eliminates the need for such devices as it acts to prevent "porpoising" as well as helps lower the bow and correct rim when underway.

The propeller nozzle assembly 10A shown in the drawings and described in detail herein discloses arrangements of elements of particular construction and configuration for illustrating preferred embodiments of structure and method of operation of the present invention. It is to be understood, however, that elements of different construction and configuration and other arrangements thereof, other than those illustrated and described may be employed for providing a propeller nozzle assembly 10A in accordance with the spirit of this invention, and such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

The invention claimed is:

1. A multiple nozzle Venturi system for watercraft, comprising:

(a) a first hemispherical member and a second hemispherical member, both said first hemispherical member and said second hemispherical member comprising a hemispherical structural ring and two or more hemispherical nozzle rings;

(b) said first hemispherical member and said second hemispherical member including two or more ring connecting fin struts spanning, separating and integrated into said structural ring and said two or more nozzle rings;

(c) said first hemispherical member and said second hemispherical member further comprising an upper mounting plate and a lower mounting plate spanning, separating and integrated into said structural ring and said two or more nozzle rings; and (d) a skeg shield including a T-shaped skid plate sandwiched between said lower mounting plate of said first hemispherical member and said second hemispherical member comprising an upper portion and a lower portion wherein said lower portion is removably attachable to said lower mounting plate of both said first and second hemispherical members;

wherein said T-shaped skid plate further includes a skeg lock adjustable in construction to fit a skeg located on the lower portion of a watercraft motor, whereby said skeg lock functions to stabilize the watercraft when in motion in reverse, and reinforces any fasteners used to attached said skeg shield, said T-shaped skid plate and said lower mounting plate;

and further wherein said upper mounting plate, said lower mounting plate, said skeg shield, and said skeg lock, are fastened to the watercraft motor using steel fasteners.

2. The multiple nozzle Venturi system for watercraft according to claim 1, wherein said upper mounting plate of said first hemispherical member and said second hemispherical member is attachable to an anti-cavitation plate of a stern drive, or an outboard watercraft motor.

3. The multiple nozzle Venturi system for watercraft according to claim 1, wherein said two or more nozzle rings are adjustable in angle, the Y-axis, relative to a center line W-axis of the watercraft motor's propeller, to alter a Venturi effect, and thereby increase or decrease the thrust pressure put out by the propeller.

4. The multiple nozzle Venturi system for watercraft according to claim 1, wherein said two or more nozzle rings are adjustable in shape relative to the nozzle ring cross section, to modulate a Venturi effect, and thereby increase or decrease the thrust pressure put out by the propeller.

5. The multiple nozzle Venturi system for watercraft according to claim 4, wherein said steel fasteners are comprised of stainless steel.

6. The multiple nozzle Venturi system for watercraft according to claim 1, wherein said two or more nozzle rings are adjustable in number of nozzle rings incorporated into the system, to accommodate a resulting overall Venturi effect, and thereby increase or decrease the thrust pressure put out by the propeller.

7. The multiple nozzle Venturi system for watercraft according to claim 1, wherein said first hemispherical member and said second hemispherical member are not round in shape, but are so constructed as to be half square in shape, and further comprise a half square shaped structural ring and two or more half square shaped nozzle rings.

8. The multiple nozzle Venturi system for watercraft according to claim 1, wherein said first hemispherical member and said second hemispherical member are not round in shape, but are so constructed as to be half rectangular in shape, and further comprise a half rectangle shaped structural ring and two or more half rectangle shaped nozzle rings.

9. The multiple nozzle Venturi system for watercraft according to claim 1, wherein said first hemispherical member and said second hemispherical member are not round in shape, but are so constructed as to be half polygonal in shape, and further comprise a half polygonal shaped structural ring and two or more half polygonal shaped nozzle rings.

10. The multiple nozzle Venturi system for watercraft according to claim 1, wherein said first hemispherical member and said second hemispherical member are not round in shape, but are so constructed as to be half elliptical in shape, and further comprise a half elliptical shaped structural ring and two or more half elliptical shaped nozzle rings.

11. A multiple nozzle Venturi system for watercraft comprising:

(a) a first hemispherical member and a second hemispherical member, both said first hemispherical member and said second hemispherical member comprising a hemispherical structural ring and two or more hemispherical nozzle rings;

(b) said first hemispherical member and said second hemispherical member including two or more ring connecting fin struts spanning, separating and integrated into said structural ring and said two or more nozzle rings;

(c) said first hemispherical member and said second hemispherical member further comprising an upper mounting plate and a lower mounting plate spanning, separating and integrated into said structural ring and said two or more nozzle rings;

(d) a skeg shield removably attachable to a skeg located on the lower portion of a watercraft motor, comprising an upper portion and a lower portion wherein said lower portion is removably attachable to said lower mounting plate of both said first and second hemispherical members and further wherein said skeg shield includes a T-shaped skid plate sandwiched between said lower mounting plate of said first hemispherical member and said second hemispherical member and wherein said T-shaped skid plate further includes a skeg lock adjustable in construction to fit a skeg located on the lower portion of a watercraft motor, whereby said skeg lock functions to stabilize the watercraft when in motion in reverse, and reinforces any fasteners used to attach said skeg shield, said T-shaped skid plate and said lower mounting plate; and (e) one or more rear safety rings comprising an upper safety ring mounting plate and a lower safety ring mounting plate whereby said upper and lower mounting plates allow said one or more safety rings to be removably attachable to the multiple nozzle Venturi system for watercraft.

12. The multiple nozzle Venturi system for watercraft according to claim 11, wherein said upper mounting plate of said first hemispherical member and said second hemispherical member is attachable to an anti-cavitation plate of a stern drive, or an outboard watercraft motor.

13. The multiple nozzle Venturi system for watercraft according to claim 11, wherein said two or more nozzle rings are adjustable in angle, the Y-axis, relative to a center line W-axis of the watercraft motor's propeller, to alter a Venturi effect, and thereby increase or decrease thrust pressure put out by the propeller.

14. The multiple nozzle Venturi system for watercraft according to claim 11, wherein said two or more nozzle rings are adjustable in shape relative to the nozzle ring cross section, to modulate a Venturi effect, and thereby increase or decrease the thrust pressure put out by the propeller.

15. The multiple nozzle Venturi system for watercraft according to claim 11, wherein said two or more nozzle rings are adjustable in number of nozzle rings incorporated into the system, to accommodate a resulting overall Venturi effect, and thereby increase or decrease thrust pressure put out by the propeller.

16. The multiple nozzle Venturi system for watercraft according to claim 11, wherein said upper mounting plate, said lower mounting plate, said skeg shield, and said skeg lock, are fastened to the watercraft motor using steel fasteners.

17. The multiple nozzle Venturi system for watercraft according to claim 16, wherein said steel fasteners are comprised of stainless steel.

18. A method for making a multiple nozzle Venturi system for watercraft comprising the steps of:

(a) providing a first hemispherical member and a second hemispherical member, both said first hemispherical member and said second hemispherical member comprising a hemispherical structural ring and two or more hemispherical nozzle rings;

(b) providing said first hemispherical member and said second hemispherical member including two or more ring connecting fin struts spanning, separating and integrated into said first structural ring and said two or more nozzle rings;

(c) providing said first hemispherical member and said second hemispherical member further comprising an upper mounting plate and a lower mounting plate spanning, separating and integrated into said first structural ring and said two or more nozzle rings;

(d) providing a skeg shield comprising an upper portion and a lower portion wherein said lower portion is removably attachable to said lower mounting plate of both said first and second hemispherical members wherein said skeg shield having a T-shaped skid plate sandwiched between said lower mounting plate of said first hemispherical member and said second hemispherical member and further wherein said T-shaped skid plate further includes a skeg lock adjustable in construction to fit the skeg of a stern drive or outboard watercraft motor, whereby said skeg lock functions to stabilize the watercraft when in motion in reverse, and reinforces any fasteners used to attached said skeg shield, said T-shaped skid plate and said lower mounting plate;

(e) attaching said each upper mounting plate to an anti-cavitation plate of a stern drive or outboard watercraft motor;

(f) attaching said skeg shield to the skeg of a stern drive or outboard watercraft motor; and (g) attaching said each lower mounting plate to said skeg shield.

19. The method for making a multiple nozzle Venturi system for watercraft according to claim 18, further comprising the steps of:

(a) providing one or more safety rings removably attachable to the multiple nozzle Venturi system for watercraft; and (b) attaching said one or more safety rings to the multiple nozzle Venturi system.

20. The method for making a multiple nozzle Venturi system for watercraft according to claim 18, further comprising the step of adjusting said two or more nozzle rings in angle, the Y-axis, relative to a center line W-axis of the watercraft motor's propeller, to alter a Venturi effect, and thereby increase or decrease the thrust pressure put out by the propeller.

21. The method for making a multiple nozzle Venturi system for watercraft according to claim 18, further comprising the step of adjusting said two or more nozzle rings in shape relative to the nozzle ring cross section, to modulate a Venturi effect, and thereby increase or decrease thrust pressure put out by the propeller.

22. The method for making a multiple nozzle Venturi system for watercraft according to claim 18, further comprising the step of adjusting two or more nozzle rings are in the overall number of nozzle rings incorporated into the system, to accommodate a resulting overall Venturi effect, and thereby increase or decrease thrust pressure put out by the propeller.

23. The method for making a multiple nozzle Venturi system for watercraft according to claim 18, wherein said step of providing a first hemispherical member and a second hemispherical member, both said first hemispherical member and said second hemispherical member comprising a hemispherical structural ring and two or more hemispherical nozzle rings includes providing first and second members that are not round in shape but square in shape.

24. The method for making a multiple nozzle Venturi system for watercraft according to claim 18, wherein said step of providing a first hemispherical member and a second hemispherical member, both said first hemispherical member and said second hemispherical member comprising a hemispherical structural ring and two or more hemispherical nozzle rings includes providing first and second members that are not round in shape but rectangular in shape.

25. The method for making a multiple nozzle Venturi system for watercraft according to claim 18, wherein said step of providing a first hemispherical member and a second hemispherical member, both said first hemispherical member and said second hemispherical member comprising a hemispherical structural ring and two or more hemispherical nozzle rings includes providing first and second members that are not round in shape but polygonal in shape.

26. The method for making a multiple nozzle Venturi system for watercraft according to claim 18, wherein said step of providing a first hemispherical member and a second hemispherical member, both said first hemispherical member and said second hemispherical member comprising a hemispherical structural ring and two or more hemispherical nozzle rings includes providing first and second members that are not round in shape but elliptical in shape.

* * * * *